US006698413B1

(12) United States Patent
Ecklund

(10) Patent No.: US 6,698,413 B1
(45) Date of Patent: Mar. 2, 2004

(54) COMPRESSION SPRING POWERED, RIGID LIMB BOW

(76) Inventor: Mark D. Ecklund, 2505 Country Creek La., Weston, WI (US) 54476

( * ) Notice: Subject to any disclaimer, the term of this patent is extended or adjusted under 35 U.S.C. 154(b) by 0 days.

(21) Appl. No.: 10/431,554

(22) Filed: May 7, 2003

Related U.S. Application Data

(60) Provisional application No. 60/380,358, filed on May 14, 2002.

(51) Int. Cl.[7] ..... F41B 5/10; F41B 5/00

(52) U.S. Cl. ..... 124/25.6; 124/23.1

(58) Field of Search ..... 124/23.1, 25.6, 124/86, 88

(56) References Cited

U.S. PATENT DOCUMENTS

| | | | |
|---|---|---|---|
| 1,932,195 | A | 10/1933 | Stroup |
| 3,989,026 | A | 11/1976 | Nishioka |
| 4,041,927 | A | 8/1977 | Van House |
| 4,334,678 | A | 6/1982 | Doyel |
| 4,338,909 | A | 7/1982 | Plummer |
| 4,756,295 | A | 7/1988 | Guzzetta |
| 4,903,677 | A | 2/1990 | Colley et al. |
| 4,989,577 | A | 2/1991 | Bixby |
| 5,054,463 | A | 10/1991 | Colley et al. |
| 5,150,699 | A | 9/1992 | Boissevain |
| 5,205,269 | A | 4/1993 | Guzzetta |
| 5,224,464 | A | 7/1993 | Burnham et al. |
| 5,373,831 | A | 12/1994 | Cushman |
| 5,503,135 | A | 4/1996 | Bunk |

*Primary Examiner*—John A. Ricci
(74) *Attorney, Agent, or Firm*—Andrus, Sceales, Starke & Sawall, LLP

(57) ABSTRACT

An archery bow includes a rigid frame having an upper limb, an opposite lower limb and a handle therebetween. A bowstring has one end attached to an upper wheel rotatably mounted to the upper limb and another end attached to a lower wheel rotatably mounted to the lower limb. The lower limb screwthreadedly receives an adjustable, rotatable self-contained tensioning unit having a variably compressible power coil spring therein. A cam is rotatably mounted to the lower limb between the lower wheel and the tensioning unit and is engaged by a cable which connects the spring with the lower wheel so as to provide a resilient pull to establish a draw weight required to move the bowstring from an at-rest position to a drawn position. A pin is variably positioned on the lower wheel for movement towards an engagement with a stop member fixed on the lower limb so as to establish a desired draw length for the bow. An independently adjustable let-off mechanism is mounted on the lower limb and is engageable with the let-off pin for selectively reducing the draw weight on the bowstring once the bowstring reaches the drawn position.

25 Claims, 8 Drawing Sheets

COMPRESSION SPRING POWERED, RIGID LIMB BOW

CROSS REFERENCE TO RELATED APPLICATION

This application relates to and claims priority from Provisional U.S. Patent Application Serial No. 60/380,358 filed May 14, 2002.

FIELD OF THE INVENTION

The present invention relates generally to a compression spring powered, archery bow which is adjustable for draw weight, draw length and draw weight let-off at full draw length in a rigid frame that is integrated to form one continuous loop in the shape of a contemporary archery bow.

BACKGROUND OF THE INVENTION

Many attempts have been made in the development of the archery bow to make it more adjustable in order to provide a single design which can be used universally by archers of all ages. The present designs generally all lack the ability to perform this task while being compact, easily and independently adjusted, simplistic, cost effective and aesthetically pleasing. Prior art in this filed shows designs that are overly complex or designs that do not fill the above stated criteria.

U.S. Pat. No. 4,903,677 issued to Colley et al. on Feb. 27, 1990 describes an archery bow in which at least one flat wound coil spring is mounted on a rigid limb frame and is connected through an eccentric wheel or cam, a drive sprocket and a drive wheel or storage spool to a bowstring so that the action of drawing back the bowstring causes the flat wound coil spring to be wound up storing energy. A let-off arrangement for reducing the force string movement of the string between an at-rest position and a fully drawn position is a function of the flat wound coil spring, the eccentric wheel or cam and the relative dimensions of the drive sprocket and storage spool. The size of the storage spool determines the amount of draw length by functioning to store more or less bowstring in the at-rest position of the bow. Draw weight adjustment is limited to altering the pre-load on the flat wound coil spring at the time that the spring is installed on the bow. In this design, let-off action is interdependent upon larger and smaller diameter drive and driven wheels, their mounting shafts, and the eccentric wheel or cam. In addition, draw weight and draw length adjustment are not easily accomplished without an involved interchanging of the storage spool and flat wound coil spring, respectively.

U.S. Pat. No. 5,503,135 issued to Bunk on Apr. 2, 1996 discloses an archery apparatus which includes a main sheave rotatably mounted on the lower limb of a rigid main frame and engaged with a bowstring extending between guide sheaves on opposing ends of the frame. A pair of tensioning mechanisms are located on opposite sides of the lower limb of the frame for selectively applying torque to the main sheave responsive to drawing of the bowstring. Each tensioning mechanism includes a coil spring, a cable attached at one end to the spring and at another end to a connection member on the sheave, and a cam sheave engaged by the cable and rotatably mounted on the frame in spaced relationship from the main sheave. Any desired residual level of draw weight let-off is provided as the periphery of the cam sheaves come into alignment with the connection members of the tensioning cables and the rotational axis of the main sheave. A pair of stop members is removably attached to the main sheave so as to abut the lower limb of the frame at the point of maximum desired draw length. The design of this archery bow does not allow a full range of onboard adjustability of draw weight and the tensioning springs are attached to the lower limb using various closely spaced holes which only allows for predetermined changes in spring pressure. In addition, constant elongation of the tensioning springs will result in eventual fatigue and declining torque capability. The Bunk design also does not allow for a more complete adjustability of draw weight let-off since the let-off system is integrated or tied into the tensioning springs through a set of cables and cams which again only permits predetermined changes.

Accordingly, it is desirable to offer a differently styled spring powered, rigid limb bow which overcomes the shortcomings of the prior art, and provides a contemporary, more simplistic design having independently and more fully and easily adjustable draw weight, draw length and let-off features which enable an arrow to be accurately shot with a high level of substantially vibrationless, high energy.

SUMMARY OF THE INVENTION

It is a general object of the present invention to provide a high efficiency archery bow which is universal in usage.

It is one object of the present invention to provide a compact, rugged and easily adjustable rigid limb bow.

It is also an object of the present invention to provide a spring powered, rigid limb bow having independently adjustable draw weight, draw length and draw weight let-off adjustments.

In one aspect of the invention, an archery bow includes a rigid frame having an upper limb, an opposite lower limb and a handle therebetween. An upper wheel is rotatably mounted to a free end of the upper limb. A lower wheel is rotatably mounted to a free end of the lower limb, the lower wheel having a sprocket attached thereto. The sprocket has a diameter which is smaller than a diameter of the lower wheel. A bowstring has one end attached to the upper wheel and another end attached to the lower wheel. The bowstring is windable about respective peripheries of the upper wheel and the lower wheel and is moveable between an at-rest position and a drawn position. The lower limb has a cavity defined by wall structure threaded to receive a cooperably threaded, rotatable spring housing containing a compressible power coil spring having one end engaged against a bottom surface of the spring housing and an opposite end engaged by a holding member. A cable passes centrally through the power coil spring and has one end fastened to the holding member and an opposite end passing through the bottom surface of the spring housing and fixedly secured to the sprocket on the lower wheel. A cam is rotatably mounted to the lower limb between the lower wheel and the spring housing, the cam having a periphery engaged by the cable. With this structure, rotation of the spring housing relative to the lower limb will selectively change the compression rate of the power coil spring without the need for disassembly of the spring housing or requiring an adjustment tool to apply an adjustable torque transmitted through the cable to the lower wheel and thereby establish a variable draw weight required to move a bowstring to the drawn position.

The archery bow includes an elongated straight cross brace extending between the free ends of the upper limb and the lower limb. The opposite ends of the cross brace are connected at rotational axes of the upper wheel and the lower wheel. A synchronizing string has one end attached to the upper wheel, another end attached to the lower wheel and a midportion passing through a retainer fixed to the cross brace. A synchronizing string is windable about respective peripheries of the upper wheel and the lower wheel. The periphery of the upper wheel is formed with first and second grooved tracks and the periphery of the lower wheel is formed with first and second grooved tracks. The bowstring is wound on the first tracks of the upper wheel and the lower wheel, and the synchronizing string is wound on the second tracks of the upper wheel and the lower wheel. The lower wheel has a peripheral area formed with a plurality of threaded holes for facilitating adjustment of draw length of the bowstring. One of the holes receives a removably threaded, let-off pin engageable with a stop member located on the lower limb as the bowstring is drawn and the lower wheel is rotated against resistance of the power coil spring. The upper wheel and the lower wheel are located behind the handle of the frame. An independently adjustable, draw weight let-off mechanism is mounted on the lower limb and is engageable with the let-off pin as the bowstring is drawn and the lower wheel is rotated against resistance of the power coil spring. The adjustable let-off mechanism is independent of the power coil spring, the cable and the cam. The let-off mechanism includes a housing removably secured to the lower limb in a hole formed therethrough. The housing has an interior passageway formed by a cylindrical internal wall provided with a retainer ledge. The passageway extends from an open threaded top end through a threaded bottom end formed with a slot therein. The passageway receives a plunger held therein by the retainer ledge. The plunger has a top end formed with a chamber for retaining a let-off coil spring therein, and a bottom end having a horizontal surface and an upwardly ramped surface. A recess is defined between the bottom end of the housing and the bottom end of the plunger. The recess receives a biased spring normally urging an interference member out of the recess and partially through the slot. The open ended top end of the housing receives a threaded adjustment screw engaged against the let-off spring in the chamber of the plunger. Rotation of the adjustment screw will change the compression force exerted by the let-off coil spring and selectively control the amount of draw weight let-off desired. The let-off pin is engageable with the biased interference member as the bowstring approaches its draw weight.

In another aspect of the invention, an archery bow includes a rigid frame having an upper limb, an opposite lower limb and a handle therebetween. An upper wheel is rotatably mounted to a free end of the upper limb. A lower wheel is rotatably mounted to a free end of the lower limb, the lower wheel having a sprocket attached thereto. The sprocket has a diameter which is smaller than the diameter of the lower wheel. A bowstring has one end attached to the upper wheel and another end attached to the lower wheel. The bowstring is windable about respective peripheries of the lower wheel and the upper wheel, and is moveable between an at-rest position and a drawn position. The lower limb screwthreadedly receives an adjustable, rotatable, self-contained tensioning unit having a variably compressible power coil spring therein. The tensioning unit provides a resilient pull to establish a draw weight required to move the bowstring from the at-rest position to the drawn position. A cable passes centrally through the coil spring and has one end attached to a holding member at one end of the coil spring and an opposite end passing through the tensioning unit and fixedly secured to the sprocket on the lower wheel. A cam is rotatably mounted to the lower limb between the lower wheel and the tensioning unit and is engaged by the cable. A pin is variably positioned on the lower wheel along a peripheral area thereof for movement toward an engagement with a stop member fixed on the lower limb. A spacing between the pin and the stop member corresponds to a desired draw length for the bow. An independently adjustable draw weight let-off mechanism is mounted on the lower limb separate from the coil spring, the cable and the cam. The let-off mechanism is engageable with the pin for selectively reducing the draw weight on the bowstring once the bowstring reaches the drawn position.

The let-off mechanism is positioned between the cam and a rotational axis of the lower wheel. The let-off mechanism includes a housing removably secured to the lower limb in a hole formed therethrough. The housing has an interior passageway formed by a cylindrical internal wall provided with a retainer ledge. The passageway extends from an open threaded top end through a threaded bottom end formed with a slot therein. The passageway receives a plunger held therein by the retainer ledge. The plunger has a top end formed with a chamber for retaining a let-off coil spring therein, and a bottom end having a horizontal surface and an upwardly ramped surface. A recess is defined between the bottom end of the housing and the bottom end of the plunger. The recess receives a biased spring normally urging an interference member out of the recess and partially into the slot. The open threaded top end of the housing receives a threaded adjustment screw engaged against the let-off spring in the chamber of the plunger. Rotation of the adjustment screw will change the compression force exerted by the let-off coil spring and selectively control the amount of draw weight let-off desired. The rotational axis of the lower wheel is substantially parallel to a longitudinal axis of the housing in the let-off mechanism. An elongated straight cross brace extends between the free ends of the upper limb and the lower limb. The cross brace is aligned with rotational axes of the upper wheel and the lower wheel. A synchronizing string has one end attached to the upper wheel, and another end attached to the lower wheel and a midportion passing through a retainer fixed on the cross brace. The synchronizing string is windable about respective peripheries of the upper wheel and the lower wheel. The stop member is located beneath the let-off mechanism and partially overlaps the slot formed in the bottom end of the housing. The cam has a first circular periphery, and a second eccentric periphery adjacent to the circular periphery.

In yet another aspect of the invention, an archery bow has a frame with an upper limb, an opposite lower limb and a handle therebetween, a bowstring extending between the upper limb and the lower limb and wound about a wheel rotatably mounted on one of the limbs and a spring operably connected to the wheel for establishing a desired draw weight for moving the bowstring from an at-rest position. The wheel is rotated as the bowstring is drawn. The invention is improved by means of a let-off pin variably positioned on the rotatable wheel, and an independently adjustable let-off mechanism located on the wheel mounting limb in a hole formed therein and selectively engaged by the let-off pin for reducing the draw weight required to move the bowstring towards the drawn position. The let-off mechanism includes a biased spring for exerting a first force to normally urge an interference member to a first position, and a let-off spring for exerting a second force larger than the first force and defining a draw weight reduction force. The let-off pin engages the interference member overcoming the first force of the biased spring in a first position, and the let-off pin engages the interference member overcoming the second force of the let-off spring in a second position.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
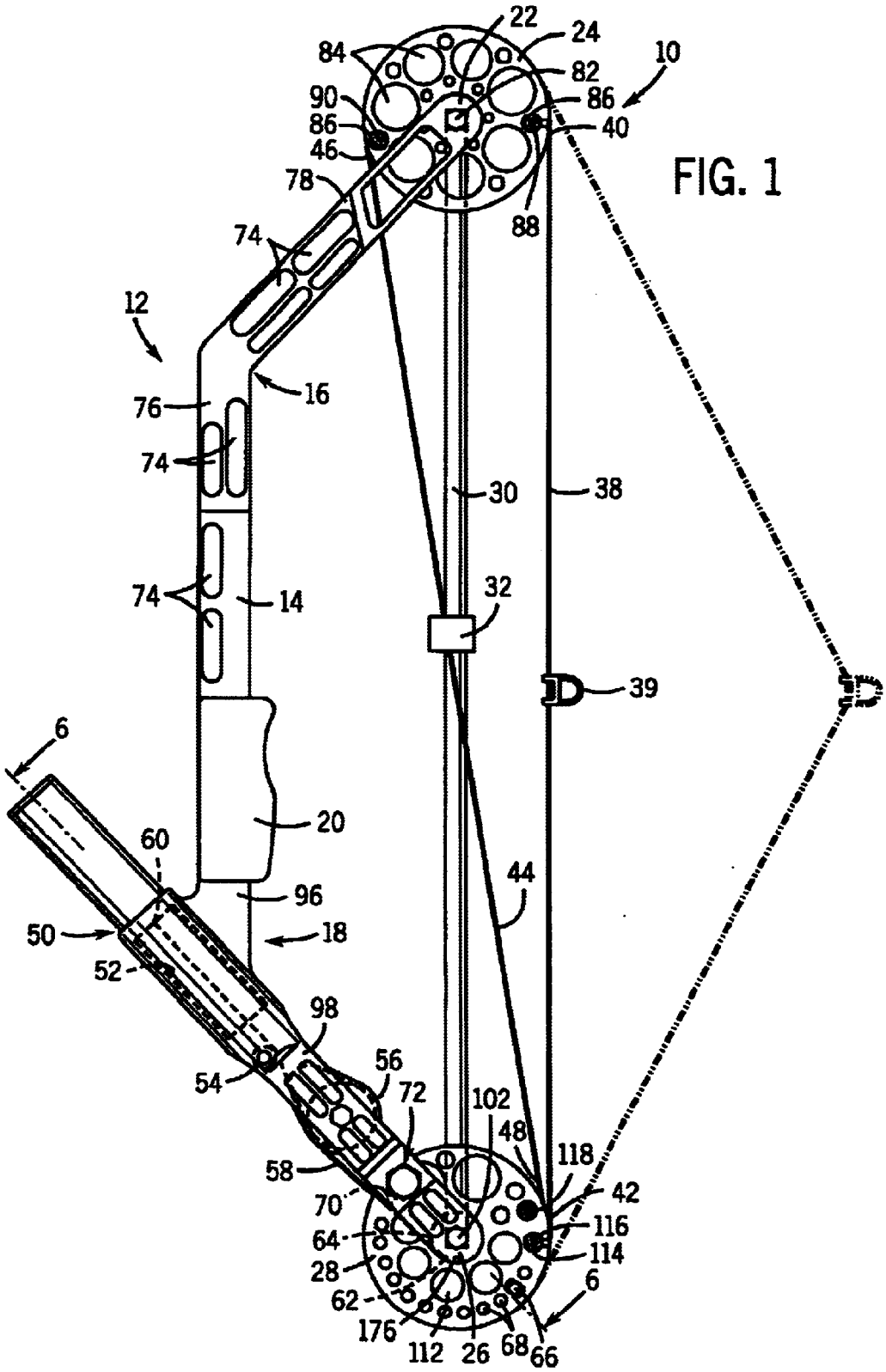
FIG. 1 is a left side elevational view of the archery bow embodying the present invention.
Figure 2:
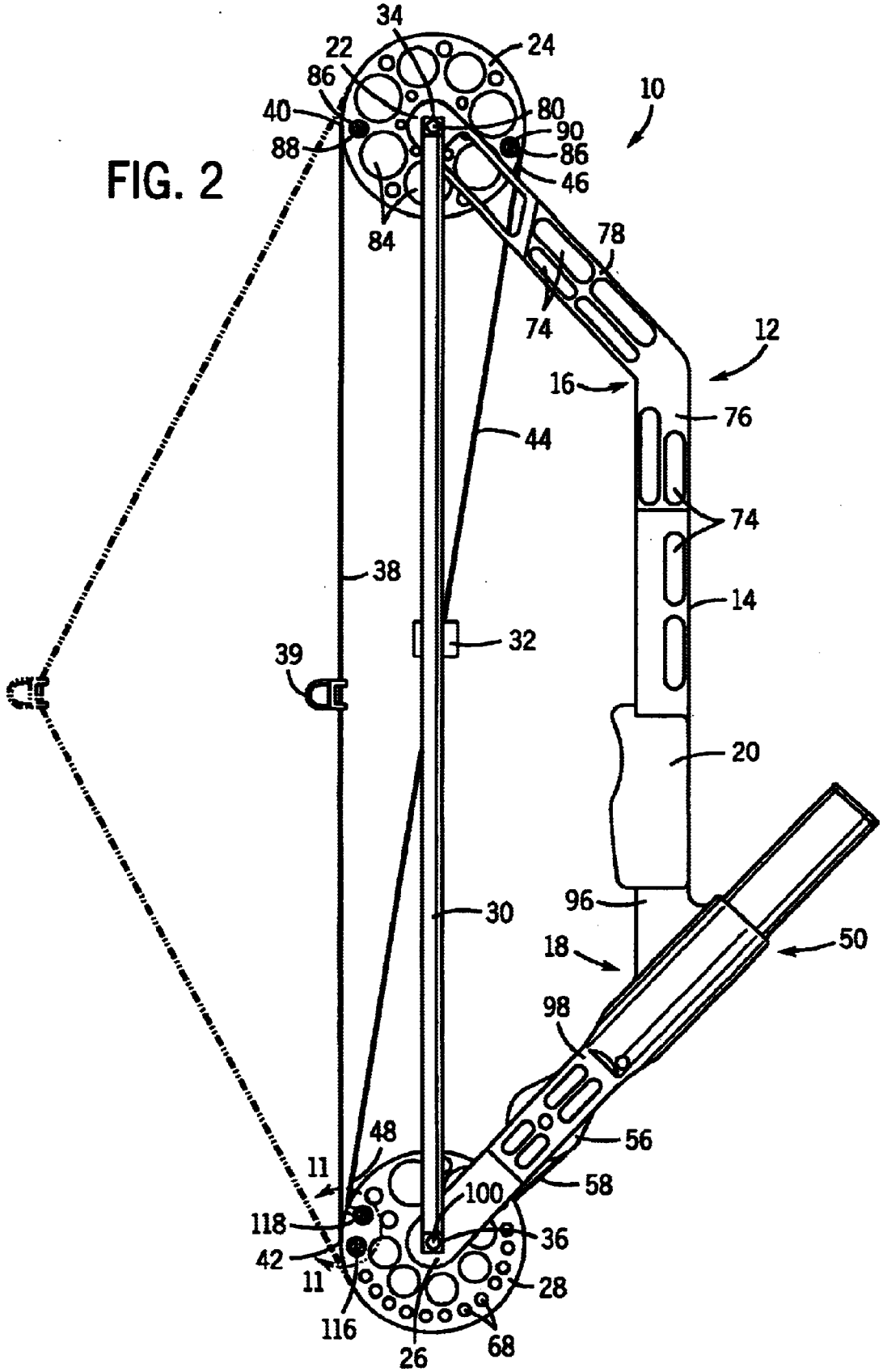
FIG. 2 is a right side elevational view of the archery bow in FIG. 1.

Referring now the drawings, FIGS. 1 and 2 generally illustrate an archery bow 10 embodying the present invention. At the outset, a brief overview of the structure and function of the archery bow 10 will be presented to be followed by a more elaborative description.

The archery bow 10 includes a rigid main frame 12 having a midportion 14, an upper limb 16 extending from an upper end of the midportion 14 and a lower limb 18 extending from a lower end of the midportion 14 and upon which a handle 20 is mounted. The upper limb 16 terminates in a bifurcated free end 22 upon which an upper wheel 24 is rotatably mounted. Similarly, the lower limb 18 has a bifurcated free end 26 upon which a lower wheel 28 is rotatably mounted. A frame cross brace 30, which is shown as being cylindrical, is rigidly connected to the respective free ends 22, 26 of the upper limb 16 and the lower limb 18, and carries a fixed guide retainer 32 at generally the midpoint thereof. The cross brace 30 has opposite ends 34, 36 connected at rotational axes of the upper and lower wheels 24, 28. A bowstring 38 equipped with a nocking device 39 spans the upper and lower wheels 24, 28, and opposite ends 40, 42 thereof wrap around and are connected to peripheral locations on the upper and lower wheels 24, 28. A synchronizing string 44 passes through the guide retainer 32 on the cross brace 30, and has opposite ends 46, 48 which wind about and are secured to peripheral locations other than those used for connecting ends 40, 42 of the bowstring 38.

The archery bow 10 also includes a self-contained tensioning unit 50 having a compressible power coil spring 52 incorporated in the lower limb 18 for tensioning the bowstring 38 without flexing the rigid frame 12. An idler roller 54 and a cam 56 are each rotatably mounted to the lower limb 18 on axes generally parallel to one another. A cable 58 is connected at one end 60 to an upper end of the spring 52, passes over the idler roller 54, winds around the cam 56 and is fastened at an opposite end 62 to a central sprocket 64 formed integrally on the lower wheel 28. A let-off pin 66 is variably positioned in one of a plurality of holes 68 formed around the periphery of the lower wheel 28. A stop member 70 is stationarily secured to the lower limb 18 next to an adjustable let-off mechanism 72 used to reduce the amount of draw weight or draw force required to hold the bowstring 38 at its drawn position. The let-off mechanism 72 is designed to selectively apply a small biasing force as well as a larger let-off force.

In operation, pulling of the bowstring 38 with an arrow nocked therein from an at-rest position shown in solid lines to a drawn position shown in phantom lines will cause the upper and lower wheels 24, 28 to rotate. Rotation of the lower wheel 28 causes the cable 58 attached to the sprocket 64 to compress the power coil spring 52 and, at the same time, rotate the cam 56 off center. This action results in a tensioning pull or torque applied to the lower wheel 28 which determines the draw weight or draw force required to draw the bowstring 38. As the bowstring 38 moves towards maximum draw, the lower wheel 28 will have rotated so that the let-off pin 66 thereon approaches the let-off mechanism 72 and the stop member 70. The let-off mechanism 72 allows the moving let-off pin 66 to overcome the small biasing force and contact the stop member 70 at which point the bowstring reaches its maximum draw length. Substantially instantaneously thereafter, the let-off pin 66 encounters and overcomes the larger let-off force which offsets and reduces the draw weight or draw force so that the bowstring 38 may be more easily held without tiring effort. When it is desired to propel the arrow, the bowstring 38 is released, the let-off pin 66 will have disengaged from the let-off mechanism 72 and the draw weight or draw force will drive the arrow forward smoothly and with high velocity and accuracy.

A more detailed description of the structure and function of the archery bow 10 follows with further reference being made to FIGS. 3 through 15B.

The rigid main frame 12 is integrally fabricated in one piece, such as by casting or molding, or from multiple pieces joined together as desired, such as by fasteners. The frame is constructed preferably from aluminum or a carbon fiber composite, but may also be made of other inflexible, rugged and durable materials. The frame 12 is formed with a series of material relieving voids 74 for reducing the weight of the frame 12 without sacrificing its rigidity. Although not illustrated, the midportion 14 of frame 12 is desirably offset from the plane of the upper and lower limbs 16, 18 so as to accommodate the placement of an arrow in alignment with the nocking device 39 on bowstring 38. The midportion 14 also facilitates the attachment of commercially available aiming and arrow supporting devices (not shown) which do not form the present invention.

The upper limb 16 has a first vertically extending segment 76 and a second upwardly and rearwardly extending angular segment 78 to locate upper wheel 24 behind handle 20 such that the bowstring 38 attached thereto will be spaced a suitable distance relative to the midportion 14 in accordance with the length of the arrow being used. The upper wheel 24 is rotatably mounted to the free end 22 of the upper limb 16 upon a bearing-supported shaft 80 of an elongated bolt 82 passing through the center of the upper wheel 24 and defining a rotational axis thereof. The upper wheel 24 is formed with a plurality of material relieving holes 84 for weight reduction purposes, and a number of peripheral apertures 86 for receiving respective retaining pegs 88, 90 at the respective upper ends 40, 46 of the bowstring 38 and the synchronizing string 44.

Figure 4:
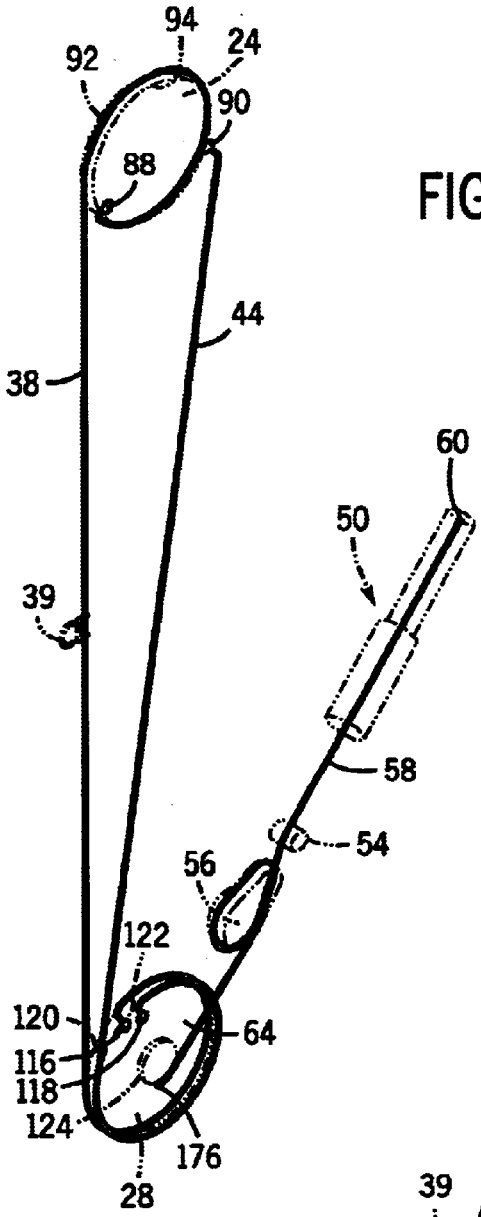
FIG. 4 is a perspective representation of certain components of the archery bow with the bowstring in an at-rest position.
Figure 5:
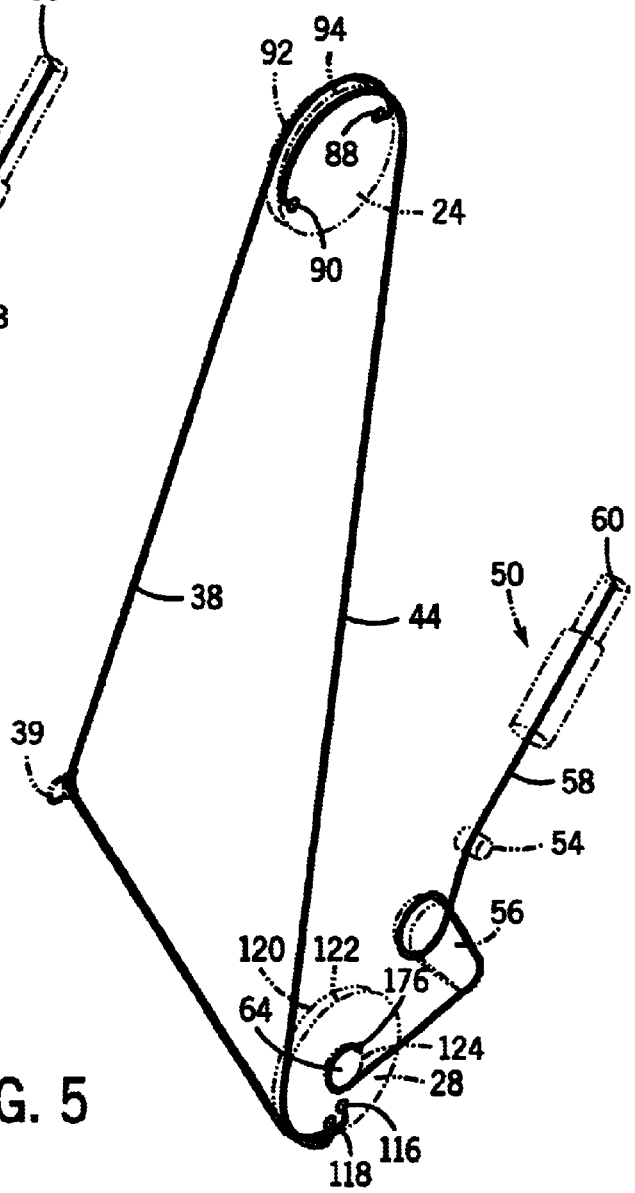
FIG. 5 is a representation like FIG. 4 showing the bowstring in a drawn position.

As seen best in FIG. 4, the upper wheel 24 is formed with first and second grooved tracks 92, 94. An upper portion of the bowstring 38 is wound about the entire periphery of the upper wheel 24 in the first grooved track 92 when the bowstring is at-rest, and terminates in the retaining peg 88. An upper end 46 of the synchronizing string 44 terminates in the retaining peg 90 located approximately 180 degrees from the bowstring retaining peg 88. As depicted in FIG. 5, an upper portion of the synchronizing string 44 is entrained or wrapped around a portion of the upper wheel periphery in the second grooved track 94 when the bowstring 38 is drawn and the upper wheel 24 is rotated. Simultaneously, the upper portion of the bowstring 38 partially unwinds from the first grooved track 92 as the bowstring 38 is drawn and the upper wheel 24 rotates against the pull of the compressible spring 52 as transmitted by the synchronizing string 44.

Figure 6:
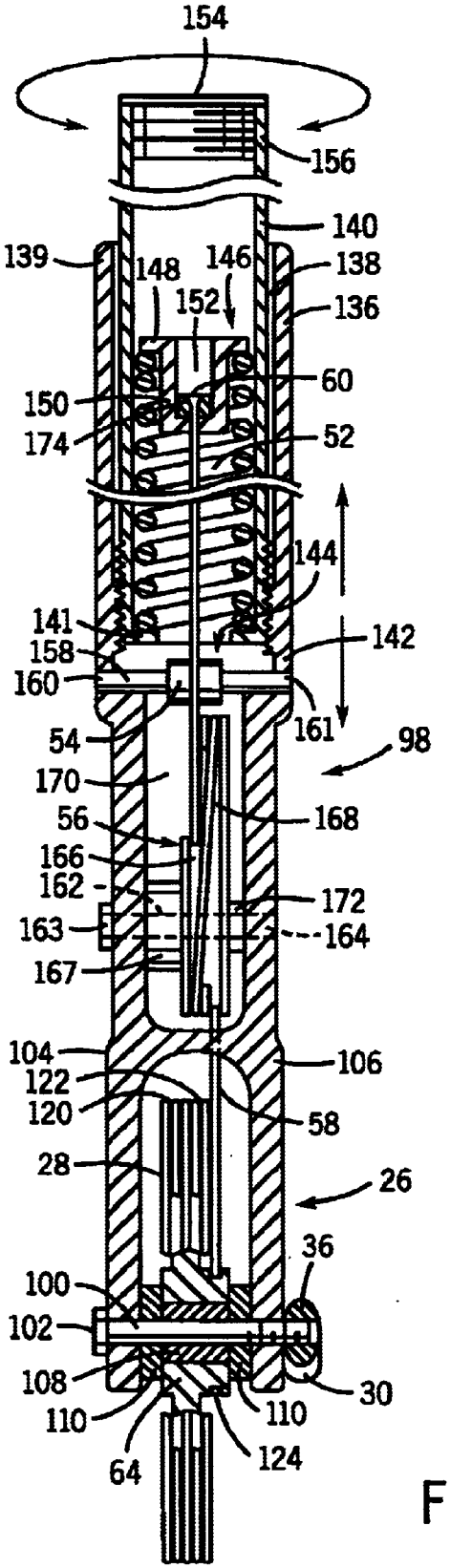
FIG. 6 is cross sectional view taken on line 6—6 of FIG. 1.

Referring now to FIGS. 1, 2 and 6, the lower limb 18 has a first vertically extending segment 96 for mounting handle 20, and a second downwardly and rearwardly extending angular segment 98 to locate the lower wheel 28 behind handle 20 in alignment with the upper wheel 24. The lower wheel 28 is rotatably mounted to the bifurcated free end 26 of the lower limb 18 upon a shaft 100 of an elongated bolt 102 passing through the center of the internal sprocket 64 on lower wheel 28, a pair of legs 104, 106 on the bifurcated free end 26 and a set of bearings 108, 110 surrounding the shaft 100 and positioned between each leg 104, 106 and each side of the sprocket 64. The bolt 102 defines a rotational axis upon which the lower wheel 28 turns. The bearings 108, 110 help to minimize friction and vibration as the bowstring 38 is drawn. The end of the shaft 100 is externally threaded into an internally threaded lower end 36 of the cross brace 30. It should be understood that the structure set forth for the bolt 102, the bifurcated legs 104, 106, the internal sprocket 64, the bearings 108, 110 and the cross brace end connection at 36 are identical for the upper wheel 24 previously described herein.

The lower wheel 28 is formed with a plurality of material relieving holes 112 for weight reduction purposes, and a number of peripheral apertures 114 for receiving respective retaining pegs 116, 118 (FIG. 11) at the lower ends 42, 48 of the bowstring 38 and the synchronizing string 44. As shown in FIGS. 4, 5, and 6, the lower wheel 28 is formed with first, second and third grooved tracks 120, 122, 124. A lower portion of the bowstring 38 is wound around substantially the entire periphery of the lower wheel 28 and the first grooved track 120 when the bowstring 38 is at-rest, and terminates in the retaining peg 116. A lower portion of the synchronizing string 44 is wound about the entire periphery of the lower wheel 28 in the second grooved track 122 when the bowstring 38 is at-rest, and terminates in the retaining peg 118. The third grooved track 124 is formed on the sprocket 64 and is used to engage the cable 58 as will be understood more fully below. As depicted in FIG. 5, lower portions of the bowstring 38 and synchronizing string 44 are partially unwound from the respective first and second grooved tracks 120, 122 as the bowstring 38 is drawn and the lower wheel 28 rotates against the pull of the compressible spring 52. The lower wheel 28 further has a group of the threaded holes 68 along its periphery to facilitate adjustment of the draw length of the bowstring 38. One of the threaded holes 68 threadably receives a shank 128 of the let-off pin 66. As seen in FIGS. 7 through 10, the let-off pin 66 has a domed head 130 which is selectively engaged with an edge of the stop member 70 lying along the inside surface of leg 104 when the lower wheel 28 rotates as the bowstring 38 is drawn. The stop member 70 has a threaded shaft 132 which is cooperably received in a threaded hole 134 formed through the leg 104.

It is one distinctive feature of the invention that the let-off pin 66 is selectively positioned in any one of the threaded holes 68 so as to vary the distance between the stop member 70 and the let-off pin 66. This variation of spacing equates to an independent, convenient and quick adjustment of the draw length of the bowstring 38.

The angular segment 98 of the lower limb 18 includes a cylindrical section 136 having a cavity 138 formed by internal, cylindrical wall structure which is threaded at a lower end thereof as illustrated in FIG. 6. The cylindrical section 136 has an open top end 139 and an open bottom end 142. The cavity 138 is designed to threadably receive a threaded, rotationally adjustable spring housing 140 for holding the compressible power coil spring 52 such that a lower end of the spring 52 rests against a bottom end 141 of the housing 140 formed with a hole 144 therethrough. An upper end of the spring 52 is fitted with a plug 146 having a radially extending top section 148 supported on the top of the spring 52, and a depending lower section 150 which projects partially into a space into the center of the spring coils. The plug 146 is formed with an internal pocket 152,for a purpose to be appreciated hereafter. A removable end cap 154 is threaded into an open top end 156 of the housing 140 and provides access thereto.

It is another distinctive feature of the invention that the self-contained tensioning unit 50 comprised of the spring 52, and the spring housing 50 is rotatable either clockwise or counterclockwise as shown by the arrows in FIG. 6 at the top end of spring housing 140 so as to move the spring housing 140 up and down as depicted by the arrows at the side of the cylindrical section 136. This motion has the effect of selectively and independently varying the compression rate of the spring 52 in order to infinitely adjust the desired draw weight or draw force required to draw the bowstring 38 without the absolute necessity of replacing the spring 52.

Below the lower end of the spring housing 140, a pin 158 is passed through the idler roller 54 rotatably and centrally mounted thereon. The pin 158 has opposite ends 160, 161 which are fixedly retained in the upper ends of the spaced apart legs 104, 106.

Beneath the pin 158 on the lower limb 18, the cam 56 is rotatably mounted on a shaft 162 of an elongated bolt 163 having an end 164 which is threaded into the leg 106. The cam 56 includes a circular portion 166 having a hub 168 projecting to one side thereof, and an eccentric portion 168 which, in the preferred embodiment, is centrally aligned with a longitudinal axis of the lower limb 18 so that it lies in a recess 170 between the legs 104, 106 when the bowstring 38 is at-rest as shown in FIG. 6. It should be understood, however, that the initial position of the cam 56 may be adjusted to obtain different draw characteristics as will be explained later. A bearing 172 is mounted on the shaft 162 between the eccentric portion 168 and the inside surface of leg 106 to minimize friction and hold the cam 56 at a desired axial position on the shaft 162.

The cable 58 is used to transmit the pull of the compressible coil spring 52 to apply a torque to the lower wheel 28 which torque is transferred in a balanced manner at the same rate to the lower wheel 24 by the synchronizing string 44. An upper end 60 of the cable 58 carries an end holder 174 which is lodged against a base of the plugged pocket 152. The cable 58 then extends through the center space of the coil spring 52 and the hole 144 in the bottom end 52 of housing 140, passes over the idler roller 54, is wound about a peripheral track on the cam circular portion 166, crosses over to wind about a peripheral track on the cam eccentric portion 168 and terminates in a retaining peg 176. The peg 176 is received in an opening on the periphery of the sprocket 64 at a 6 o'clock position when the bowstring 38 is at-rest as shown in FIG. 4.

It is yet another distinctive feature of the invention that the lower limb 18 is provided with the let-off mechanism 72 which is independently adjustable to infinitely vary the reduction and draw weight or draw force required to draw the bowstring 38.

Figure 12:
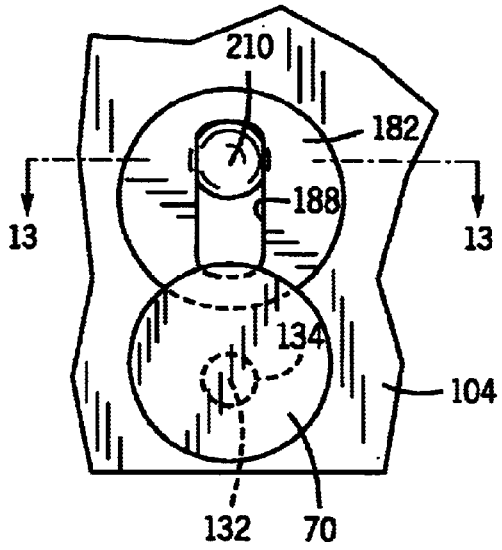
FIG. 12 is a fragmentary, sectional view taken on line 12—12 of FIG. 7.
Figure 13:
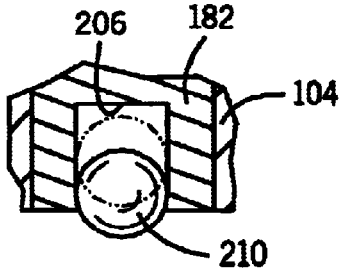
FIG. 13 is cross-sectional view taken on line 13—13 of FIG. 12.

With reference to FIGS. 7 through 10, the let-off mechanism 72 includes a cylindrical, tubular housing 178 removably secured to an outer surface of lower limb leg 104 in a threaded hole 180 formed therethrough. The let-off housing 170 has a longitudinal axis which is parallel to the rotational axis of the lower wheel 28. The housing 178 is constructed with a reduced diameter bottom end 182 which is threaded so that it can be turnably fastened in the threaded hole 180. The housing 178 defines an interior passageway 184 that extends from an open threaded top end 186 through the bottom end 182 which is formed with an oval slot 188 as shown in FIG. 12. An internal cylindrical wall of the housing 178 is provided with a retainer ledge 190 for retaining a vertically moveable plunger 192 in the passageway 184. A top end of the plunger 192 has a chamber 194 formed therein for holding a let-off coil spring 196 having a lower end resting upon a base 198 for the bottom of the chamber 194, and an upper end which is engaged by the bottom of an adjustment screw 200 threadably received in the top end of the housing 178. A bottom end 201 of the plunger 192 is configured with a horizontal surface 202 and an upwardly ramped surface 204, and a recess 206 is defined between the bottom end 201 of the plunger 192 and the bottom end 182 of the housing 178. Disposed within the recess 206 is a small bias spring 208 located beneath the ramped surface 204 for normally urging an interference member 210, such as a ball bearing, out of the recess 206 and partially through the slot 188 in the bottom end 182 of the housing 178. As seen in FIG. 12, the slot 188 is appropriately sized so that the ball bearing 210 is otherwise retained in the bottom end 182 of the housing 178. It can also be seen that the stop member 70 partially overlaps the slot 188 at one end thereof.

It is to be noted that the let-off coil spring 196 has a much greater applied force then the bias spring 208 and is chosen to exert a range of force which is less then the rotational force or torque applied to the lower wheel 28. That is, the let-off coil spring force is designed to offset or reduce the draw weight or draw force so that the bowstring 38 may be more easily held upon reaching the maximum draw and before release of an arrow nocked in the bowstring 38. The adjustment screw 200 of the let-off mechanism 72 may be turned clockwise or counterclockwise so as to selectively vary the compression rate of the let-off coil spring 196 and thereby infinitely adjust the let-off to a desired level.

A detailed operation of the archery bow 10 now follows with attention being directed particularly to FIGS. 1, 3, 4, 5, and 7 through 10.

Figure 3:
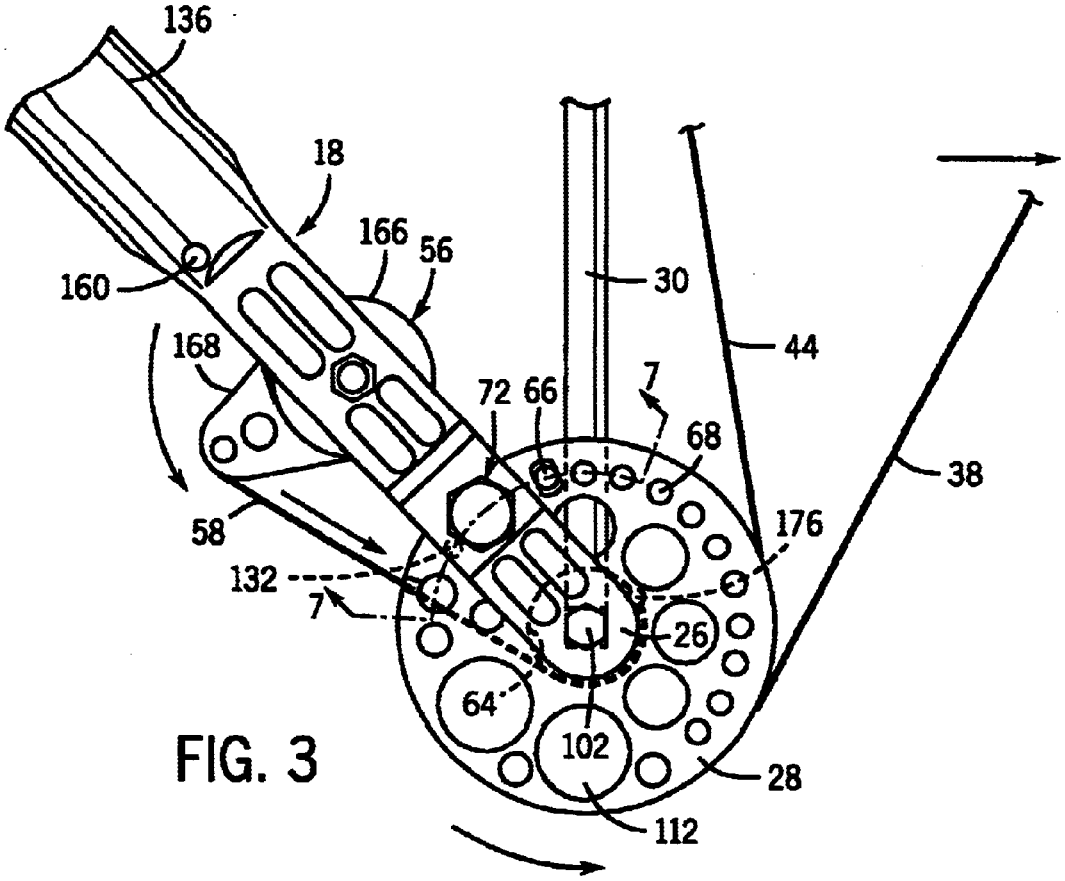
FIG. 3 is an enlarged, fragmentary elevational view of a lower portion of the archery bow as the bowstring is drawn.
Figure 11:
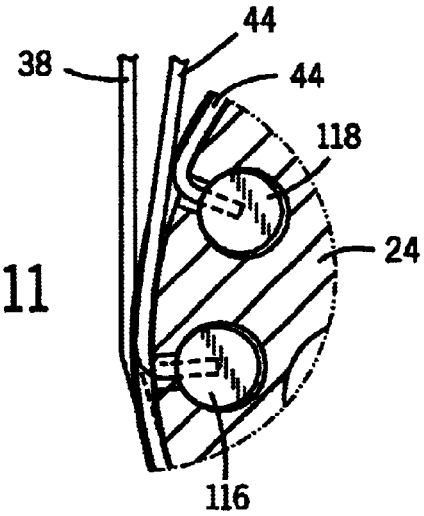
FIG. 11 is an enlarged detail view taken on line 11—11 of FIG. 2.
Figure 15A:
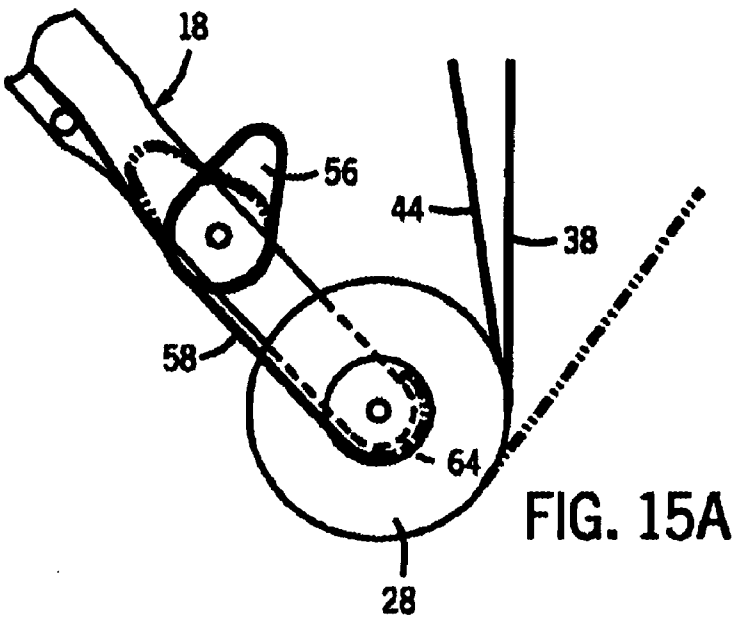
FIG. 15A is a view like FIG. 14A but showing the cam initially non-aligned with the lower limb.
Figure 15B:
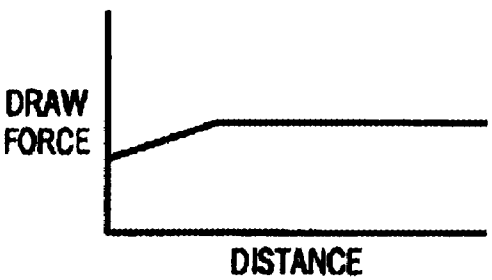
FIG. 15B is a graphical portrayal of the draw force over the distance the bowstring is drawn for the configuration shown in FIG. 15A.

With the bowstring 38 in the at-rest position of FIG. 4, the upper and lower wheels 24, 28, respectively, are stationary, and a pre-load force is applied to the lower wheel 28 via sprocket 64 by means of cable 58 which is wound about the circular periphery 166 and eccentric periphery 168 of the cam 56 and is attached to the upper end of the power coil spring 52. As seen in FIG. 1, let-off pin 66 is positioned in lower wheel 28 so as to define a predetermined draw length or maximum draw defined by the spacing along the periphery of the lower wheel 28 between the pin 66 and stop number 70. When the bowstring 38 is drawn as shown in FIGS. 3, 5 and 15A, the upper wheel 24 rotates in a clockwise direction and the lower wheel rotates in a counterclockwise direction. Rotation of the upper wheel 24 causes unwinding of an upper portion of bowstring 38 and winding of an upper portion of synchronizing string 44. Rotation of the lower wheel causes unwinding of both the bowstring 38 and synchronizing string 44. Rotation of the lower wheel also causes simultaneous rotation of integral sprocket 64 which, in turn, results in winding of cable 58 around the sprocket 64 as shown in FIG. 3. Winding of cable 58 around sprocket 64 further causes counterclockwise rotation of cam 56 and compression of power coil spring 52 (as depicted in FIG. 5) to store a quantity of draw energy therein and simultaneously apply a torque to the lower wheel 28. The torque on the lower wheel 28 is distributed to the upper wheel 24 in a balanced manner by the synchronizing string 44 which also enables the upper and lower wheels 24, 28 to rotate at the same rate.

Figure 8:
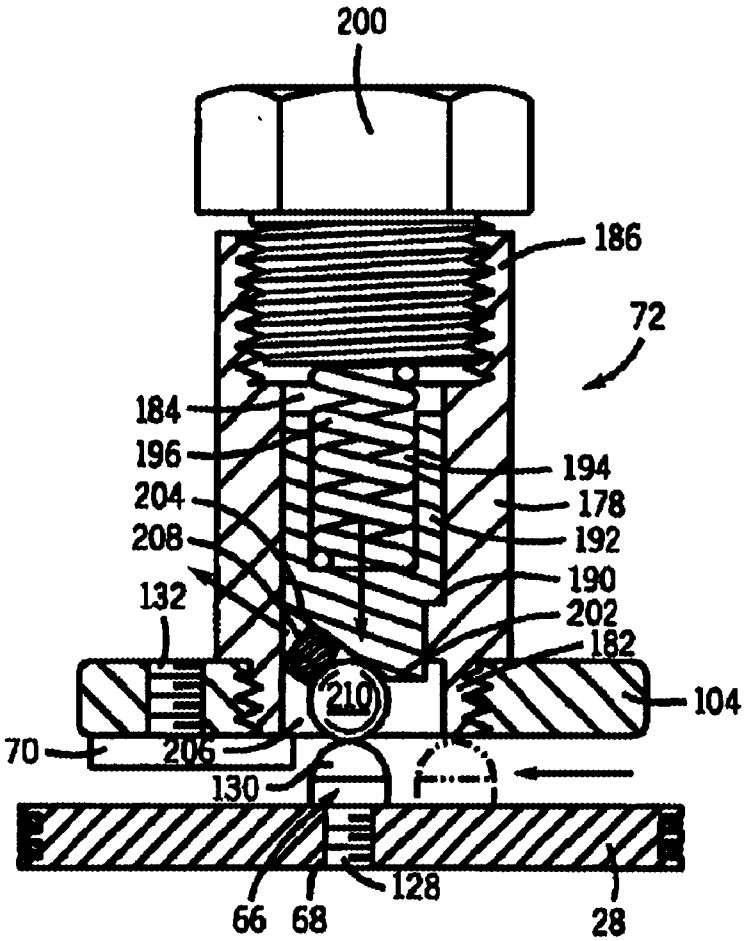
FIGS. 8 through 10 are sequential views of the action of the let-off mechanism of FIG. 7 as the bowstring is drawn.
Figure 7:
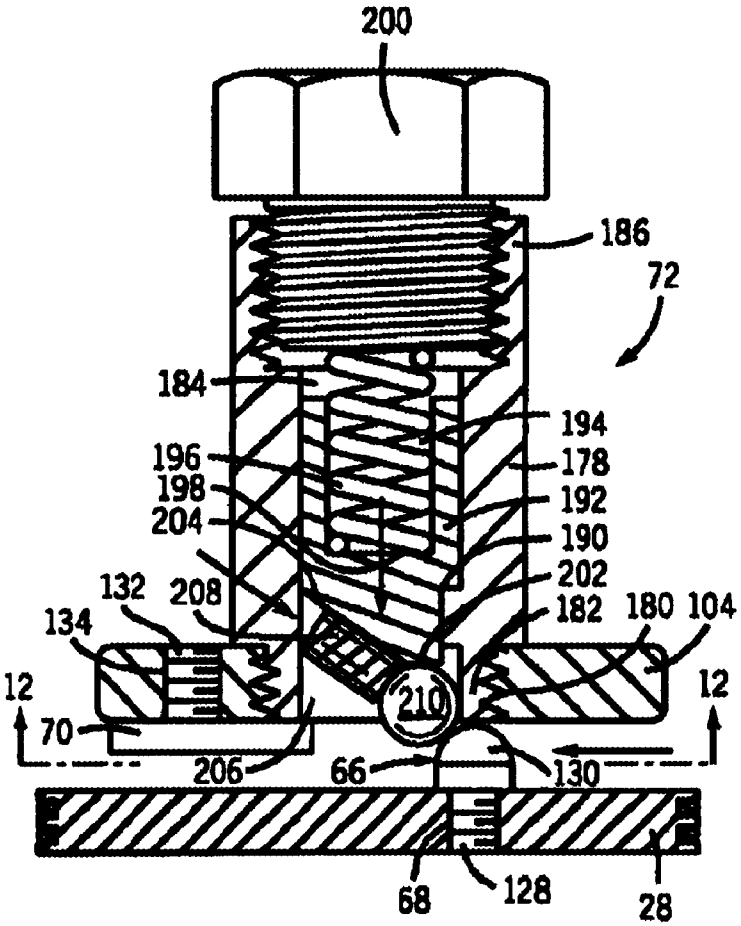
FIG. 7 is an enlarged, cross sectional view taken on line 7—7 of FIG. 3 showing initial contact of a let-off pin with a let-off mechanism.
Figure 10:
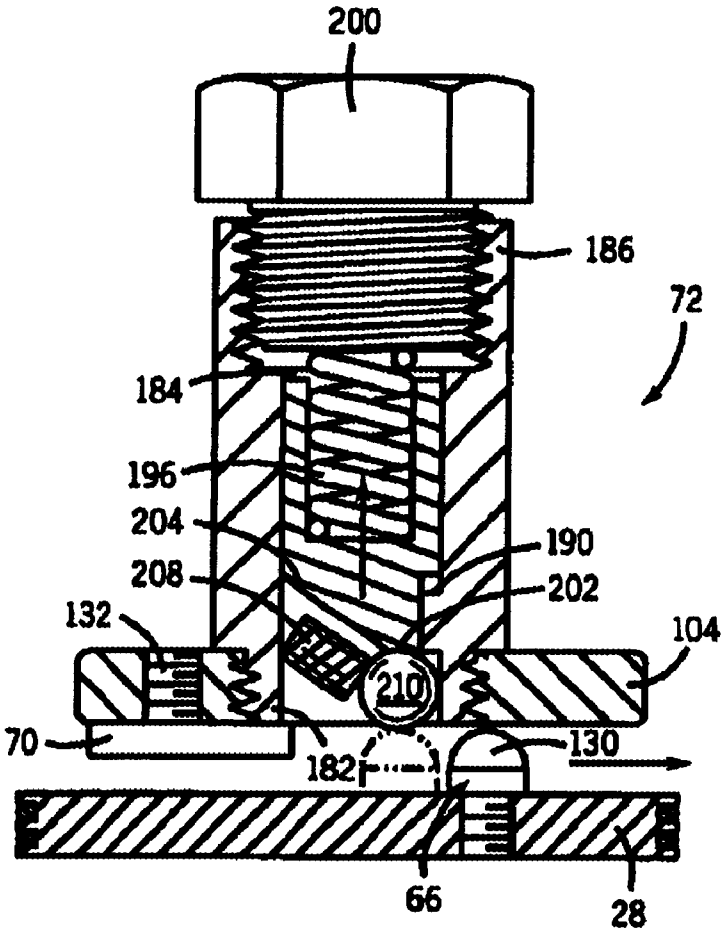
Figure 9:
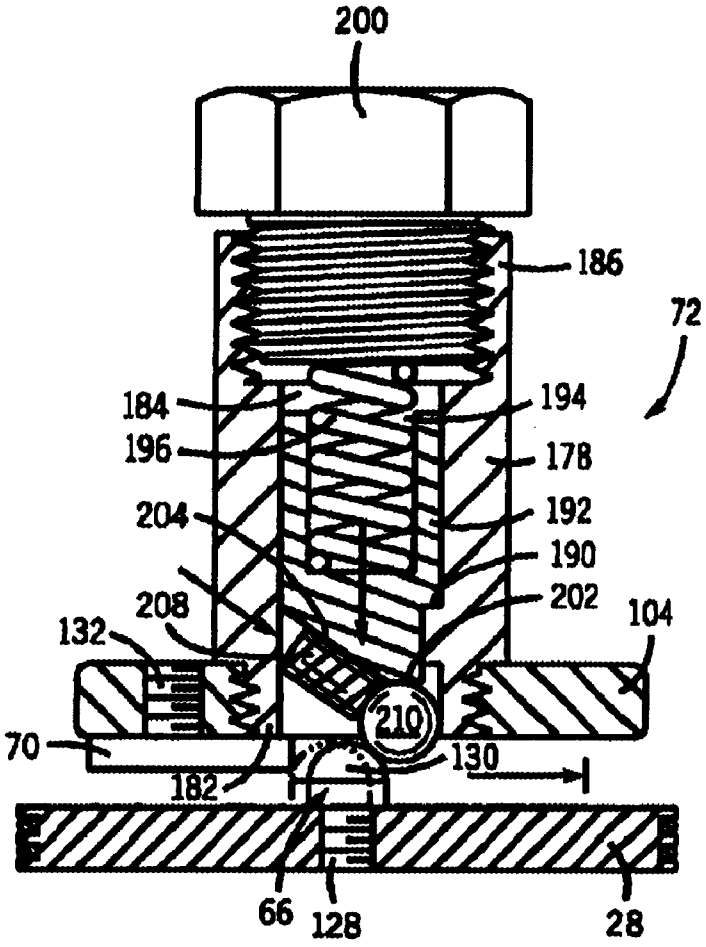
Figure 14A:
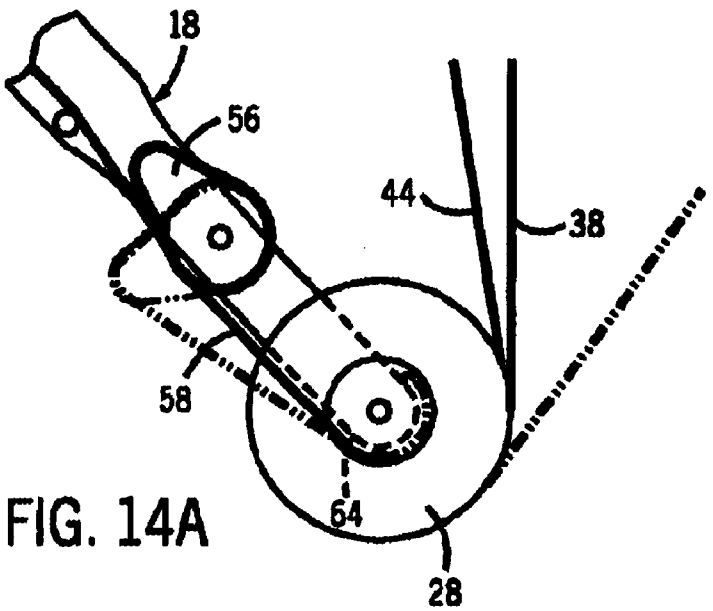
FIG. 14A is a view like FIG. 3 showing the cam initially aligned with the lower limb.
Figure 14B:
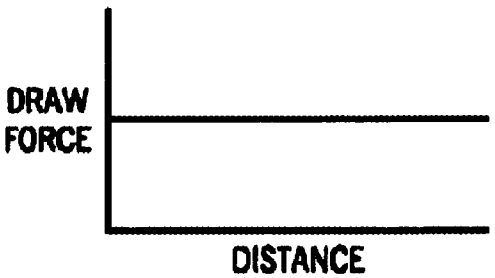
FIG. 14B is a graphical portrayal of the draw force over the distance the bowstring is drawn for the configuration shown in FIG. 14A.

FIG. 3 illustrates that as the bowstring 38 is pulled towards maximum draw, lower wheel 28 continues to rotate such that the let-off pin 66 approaches the let-off mechanism 72 and the stop member 70. As seen in FIG. 7, the domed head 130 of the let-off pin 66 on the torqued, rotating lower wheel 28 eventually engages the ball bearing 210 and forces the ball bearing 210 along the ramped surface 210 into the recess 206 against only the small force of bias spring 208 (FIG. 8). As the center of the domed head 130 of let-off pin 66 moves past the bottom of ball bearing 210 and contacts the stop member 70 (signifying the maximum draw), the ball bearing 210 is again forced into its initial position by bias spring 208 (FIG. 9). Substantially instantaneously after reaching maximum draw, the bowstring 38 is advanced a fraction of an inch so that the domed head 130 of the let-off pin 66 moves away from the stop member 70 and the torque applied to the domed head 130 overcomes the force of the let-off spring 196 acting downwardly upon the top of the ball bearing 210. This causes the plunger 192 to move slightly upwardly (FIG. 10) so that the ball bearing 210 will move correspondingly upwardly. At this point, the torque applied to the lower wheel 28 and thereby the draw weight or draw force is "let-off" or reduced by the force of the let-off spring 196 so that the bowstring 38 may be much more easily held until it is desired to release the bowstring 38 and propel an arrow nocked therein.

When the bowstring 38 is released, the stored energy in the power coil spring 52 is expended to retract the cable 58, rotate the cam 56 and upper and lower wheels 24 and 28 in opposite directions and pull the bowstring 38 forward in a smooth, high velocity manner without any vibration which would affect the accuracy of a propelled arrow.

It should be emphasized that the particular design of the cam 56 with its circular periphery 166 and eccentric periphery 168 engaged by the cable 58 between the power coil spring 52 and the lower wheel 28 rectifies the problem of non-linear force characteristics obtained by using a compression coil spring by itself. It can be said that the cam 56 acts as a pressure or force compensator so that a linear force characteristic may be realized.

It should also be understood that the initial position of the cam 56 determines a particular linear force profile. Referring to FIG. 15A, the cam is shown as described above in its initial position in solid lines with the bowstring 38 at-rest, and its rotated position in phantom lines as the bowstring 38 is drawn. Using the cam 56 in this setting will result in a constant draw weight or draw force for a distance of bowstring pull short of maximum draw. However, setting the initial solid line position of the cam 56 as shown in FIG. 15A will provide a slightly increasing draw force in the early stage of bowstring pull which draw force becomes constant for the remainder of the pull short of maximum draw. Other variations and cam positions will yield different linear force profiles.

In a specific example of the present invention, the archery bow 10 has a length of 28 inches from the center of the upper wheel 24 to the center of the lower wheel 28. The distance from the back of the handle 20 to the bowstring 38 is 7 inches. The combined length of the frame midportion 14 and the frame vertical extending segments 76, 96 is 15 inches. The length of the upper limb angular segment 78 is 9 inches, while the length of the lower limb angular segment 98 is 12 inches. The diameter of the spring housing 140 is 1⅜ inches. The diameter of the upper and lower wheels 24, 28 are 4.75 inches and their sprockets 64 have diameters of 1.2 inches so that the ratio of the wheel to sprocket diameter is 4 to 1. This particular ratio is chosen so that using a power coil spring 52 designed to deliver 240 to 480 inch-pounds of force connected in combination with the unique cam 56 will provide a wheel torque and a draw weight or draw force of about 60 inch-pounds. Advantageously, this torque value can be infinitely adjusted by simply rotating the spring housing 140 so as to change the compression rate of the power coil spring 52. If desired, the end cap 154 on spring housing 140 can be removed, the cable 58 can be disassembled and a replacement power coil spring 52 may be installed. The let-off coil spring 196 is designed to produce 45 inch-pounds of force which offsets the 60 inch-pounds of draw force so that at let-off, the required force to hold the bowstring 38 is decreased to about 15 inch-pounds. Rotating the adjustment screw 200 on the let-off mechanism 72 will selectively alter the let-off spring force so as to infinitely vary the let-off. The adjustment screw 200 can be removed as desired to replace the let-off coil spring 196. The peripheral spacing between the threaded holes 68 for retaining the let-off pin 66 and the stop member 70 translates to providing a variation of about 20 to 31 inches in draw length.

It should now be appreciated that the present invention provides a rugged, compact, rigid limb bow 10 which is universally adaptable to archers of all ages by providing independent, infinite and easy adjustments for the draw weight or draw force, the draw length and the draw weight let-off without affecting each other. The extreme rigidity provided by the frame 12 and the cross brace 30 enables significant lower vibration. The cam 56 is particularly shaped so that the cable 58 when entrained about the peripheries 166, 168 will not contact itself. The cam 58 also ensures that the force transmitted from the power coil spring 52 to the lower wheel 28 will remain constant over a distance of bowstring pull. The synchronizing string 44 serves to equally distribute torque between the upper and lower wheels 24, 28 and provide that the wheels rotate at the same rate. The archery bow 10 is more simplified, cost-effective and aesthetically pleasing than previously known bows. In contrast with the prior art, the let-off feature is not dependent on the spring, cam or cable as in other known devices. The rotatable self-contained tensioning unit 50 permits power coil spring 52 to deliver a range of different forces without disassembling the unit or requiring an adjustment tool.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. An archery bow comprising:

a rigid frame having an upper limb, an opposite lower limb and a handle therebetween;

an upper wheel rotatably mounted to a free end of the upper limb;

a lower wheel rotatably mounted to a free end of the lower limb, the lower wheel having a sprocket attached thereto, the sprocket having a diameter which is smaller then the diameter of the lower wheel;

a bowstring having one end attached to the upper wheel and another end attached to the lower wheel, the bowstring being windable about respective peripheries of the upper wheel and the lower wheel, and being moveable between an at-rest position and a drawn position;

the lower limb having a cavity defined by wall structure threaded to receive a cooperably threaded, rotatable spring housing containing a compressible power coil spring having one end engaged against a bottom surface of the spring housing and an opposite end engaged by a holding member;

a cable passing centrally through the power coil spring and having one end fastened to the holding member and an opposite end passing through- the spring housing and fixedly secured to the sprocket on the lower wheel; and a cam rotatably mounted to the lower limb between the lower wheel and the spring housing, the cam having a periphery engaged by the cable, wherein rotation of the spring housing relative to the lower limb will selectively change compression rate of the power coil spring without the need for dissassembly of the spring housing or requiring an adjustment tool to apply an adjustable torque transmitted through the cable to the lower wheel and thereby establish a variable draw weight required to move the bowstring to the drawn position.

2. The archery bow of claim 1, including an elongated, straight cross brace extending from the free ends of the upper limb and the lower limb, opposite ends of the cross brace being connected at rotational axes of the upper wheel and the lower wheel.

3. The archery bow of claim 2, including a synchronizing string having one end attached to the upper wheel, another end attached to the lower wheel and a midportion passing through a retainer fixed to the cross brace, the synchronizing string being windable about respected peripheries of the upper wheel and the lower wheel.

4. The archery bow of claim 3, wherein the periphery of the upper wheel is formed with first and second grooved tracks, and the periphery of the lower wheel is formed with first and second grooved tracks, the bowstring being wound on the first tracks of the upper wheel and the lower wheel and the synchronizing string being wound on the second tracks of the upper wheel and the lower wheel.

5. The archery bow of claim 1, wherein the lower wheel has a peripheral area formed with a plurality of threaded holes for facilitating adjustment of draw length of the bowstring, one of the holes receiving a removable threaded let-off pin engageable with a stop member located on the lower limb as the bowstring is drawn and the lower wheel is rotated against resistance of the power coil spring.

6. The archery bow of claim 5, including an independently adjustable draw weight let-off mechanism mounted on the lower limb and engageable with the let-off pin as the bowstring is drawn and the lower wheel is rotated against resistance of the power coil spring, the adjustable let-off mechanism being independent of the power spring, the cable and the cam.

7. The archery bow of claim 6, wherein the let-off mechanism includes a housing removably secured to the lower limb in a hole formed therethrough, the housing having an interior passageway formed by a cylindrical internal wall provided with a retainer ledge, the passageway extending from an open threaded top end through a threaded bottom end formed with a slot therein, the passageway receiving a plunger held therein by the retainer ledge, the plunger having a top end formed with a chamber for retaining a let-off coil spring therein, and a bottom end having the horizontal surface and an upwardly ramped surface, a recess being defined between the bottom end of the housing and the bottom end of the plunger, the recess receiving a bias spring normally urging an interference member out of the recess and partially through the slot, the open threaded top end of the housing receiving a threaded adjustment screw engaged against the let-off coil spring in the chamber of the plunger, whereby rotation of the adjustment screw will change the compression force exerted by the let-off coil spring and selectively control the amount of draw weight let-off desired.

8. The archery bow of claim 7, wherein the let-off pin is engageable with the biased interference member as the bowstring approaches its draw length.

9. The archery bow of claim 1, wherein the upper wheel and the lower wheel are located behind the handle of the frame.

10. An archery bow comprising:

a rigid frame having an upper limb, and an opposite lower limb and a handle therebetween;

an upper wheel rotatably mounted to a free end of the upper wheel;

a lower wheel rotatably mounted to a free end of the lower limb, the lower wheel having a sprocket attached thereto, the sprocket having a diameter smaller then a diameter of the lower wheel;

the bowstring having one end attached to the upper wheel and another end attached to the lower wheel, the bowstring being windable about respective peripheries of the upper wheel and the lower wheel and being moveable between an at-rest position and a drawn position;

the lower limb screwthreadedly receiving an adjustable, rotatable, self-contained tensioning unit having a variably compressible power coil spring therein, the tensioning unit providing a resilient pull to establish a draw weight required to move the bowstring from the at-rest position to the drawn position;

a cable passing centrally through the coil spring and having one end attached to a holding member at one end of the coil spring, and an opposite end passing through the tensioning unit and fixedly secured to the sprocket on the lower wheel;

a cam rotatably mounted to the lower limb between the lower wheel and the tensioning unit and engaged by the cable;

a pin variably positioned on the lower wheel along a peripheral area thereof for movement toward and engagement with a stop member fixed on the lower limb, a spacing between the pin and the stop member corresponding to a desired draw length for the bow; and an independently adjustable draw weight let-off mechanism mounted on the lower limb separate from the coil spring, the cable and the cam, and engageable with the pin for selectively reducing the draw weight on the bowstring once the bowstring reaches the drawn position.

11. The archery bow of claim 10, wherein the let-off mechanism is positioned between the cam and a rotational axis of the lower wheel.

12. The archery bow of claim 10, wherein the let-off mechanism includes a housing removably secured to the lower limb in a hole formed therethrough, the housing having an interior passageway formed by a cylindrical internal wall provided with a retaining ledge, the passageway extending from an open threaded top end through a threaded bottom end formed with a slot therein, the passageway receiving a plunger held therein by the retainer ledge, the plunger having a top end formed with a chamber for retaining a let-off coil spring therein, and a bottom end having a horizontal surface and an upwardly ramped surface, a recess being defined between the bottom end of the housing and the bottom end of the plunger, the recess receiving a bias spring normally urging an interference member out of the recess and partially through the slot, the open threaded top end of the housing receiving a threaded adjustment screw engaged against the let-off spring in the chamber of the plunger, whereby rotation of the adjustment screw will change the compression force exerted by the let-off coil spring and selectively control the amount of draw weight let-off desired.

13. The archery bow of claim 12, wherein the rotational axis of the lower wheel is substantially parallel to a longitudinal axis of the housing in the let-off mechanism.

14. The archery bow of claim 10, including an elongated, straight cross brace extending between the free ends of the upper limb and the lower limb, the cross brace being aligned with rotational axes of the upper wheel and the lower wheel.

15. The archery bow of claim 14, including a synchronizing string having one end attached to the upper wheel, another end attached to the lower wheel and a midportion passing through a retainer fixed on the cross brace, the synchronizing string being windable about the respective peripheries of the upper wheel and the lower wheel.

16. The archery bow of claim 10, wherein the stop member is located beneath the let-off mechanism and partially overlaps the slot formed in the bottom end of the housing.

17. The archery bow of claim 10, wherein the cam has a first circular periphery and a second eccentric periphery adjacent to the circular periphery.

18. In an archery bow having a frame with an upper limb, an opposite lower limb and a handle therebetween, a bowstring extending between the upper limb and the lower limb and wound about a wheel rotatably mounted on one of the limbs, and a spring operably connected to the wheel for establishing a desired draw weight for moving the bowstring from an at-rest position to a drawn position, the wheel being rotated as the bowstring is drawn, the improvement comprising:

a let-off pin variably positioned on the rotatable wheel; and an independently adjustable let-off mechanism located on the wheel mounting limb in a hole formed therein and selectively engaged by the let-off pin for reducing the draw weight required to move the bowstring towards the drawn position.

19. The improvement of claim 18, wherein the let-off mechanism includes a bias spring for exerting a first force to normally urge an interference member to a first position, and a let-off spring for exerting a second force larger than the first force and defining a draw weight reduction force.

20. The improvement of claim 19, wherein the let-off pin engages the interference member overcoming the first force of the bias spring in a first position, and wherein the let-off pin engages the interference member overcoming the second force of the let-off spring in a second position.

21. An archery bow comprising:

a rigid frame having an upper limb, an opposite lower limb and a handle therebetween;

an upper wheel rotatably mounted to the upper limb;

a lower wheel rotatably mounted to the lower limb, the lower wheel having a sprocket attached thereto, the sprocket having a diameter which is less than a diameter of the lower wheel;

a bowstring having one end attached to the upper wheel and another end attached to the lower wheel, the bowstring being windable around respective peripheries of the upper wheel and the lower wheel and being moveable between an at-rest position and a fully drawn position;

an independently adjustable constant force transmitting arrangement connected to the sprocket and incorporated in the lower limb for applying a constant torque to the lower wheel and defining a constant draw force required to draw the bowstring;

an independently adjustable draw length adjustment device located between a periphery of the lower wheel and the lower limb; and an independently adjustable let-off mechanism mounted on the lower limb and selectively engageable with a portion of the draw length adjustment mechanism for providing a reduction in draw force once the bowstring reaches the fully drawn position, the let-off mechanism being independent of the constant force transmitting arrangement.

22. The archery bow of claim 21, wherein the constant force transmitting arrangement includes a compressible power coil spring contained in a spring housing screwthreadedly received in the lower limb, a cam rotatably mounted on the lower limb between the spring housing and the lower wheel, the cam having a circular periphery and an elliptical periphery, and a cable engaged around the circular periphery and the elliptical periphery of the cam, the cable having one end attached to the power coil spring and an opposite end secured to the sprocket.

23. The archery bow of claim 22, wherein the draw length adjustment device includes a removable let-off pin positioned in one of a number of holes formed on the periphery of the lower wheel, and a stop member fixedly secured on the lower limb and engageable with the let-off pin.

24. The archery bow of claim 23, wherein the let-off mechanism is located between the let-off pin and the stop member.

25. The archery bow of claim 24, wherein the let-off mechanism includes a let-off housing having a spring arrangement biased against an interference member selectively engageable with the let-off pin before and after the let-off pin contacts the stop member.

* * * * *